US008755552B2

(12) United States Patent
Lasserre

(10) Patent No.: US 8,755,552 B2
(45) Date of Patent: Jun. 17, 2014

(54) SPEAKER SYSTEM WITH AT LEAST TWO CODIRECTIONAL CHANNELS

(75) Inventor: Sébastien Lasserre, Rennes (FR)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 12/995,971

(22) PCT Filed: Jul. 30, 2009

(86) PCT No.: PCT/IB2009/006817

§ 371 (c)(1),
(2), (4) Date: Dec. 2, 2010

(87) PCT Pub. No.: WO2010/013145

PCT Pub. Date: Feb. 4, 2010

(65) Prior Publication Data

US 2011/0116670 A1 May 19, 2011

(30) Foreign Application Priority Data

Aug. 1, 2008 (FR) ..... 08 55327

(51) Int. Cl.
*H04R 1/20* (2006.01)

(52) U.S. Cl.
USPC ..... 381/345; 381/386

(58) Field of Classification Search
USPC ..... 381/345, 182, 386, 98
See application file for complete search history.

(56) References Cited

U.S. PATENT DOCUMENTS 5,548,657 A * 8/1996 Fincham ..... 381/182
6,411,721 B1 * 6/2002 Spindler ..... 381/349
2004/0001597 A1 * 1/2004 Marton ..... 381/71.1
2004/0252859 A1 * 12/2004 Saiki ..... 381/386
2007/0127738 A1 * 6/2007 Yamada et al. ..... 381/98
2008/0175397 A1 * 7/2008 Holman ..... 381/55

FOREIGN PATENT DOCUMENTS

FR 2895202 A1 6/2007
FR 2901448 A1 * 11/2007

OTHER PUBLICATIONS

G. Matusiak, et al, "Fourth-Order Symmetrical Band-Pass Loudspeaker Systems", Journal of the Audio Engineering Society, vol. 50, No. 1/2, (Jan. 2002).

International Search Report dated Dec. 21, 2009 in International Application No. PCT/IB2009/006817.

* cited by examiner

*Primary Examiner* — Duc Nguyen

*Assistant Examiner* — Phan Le

(74) *Attorney, Agent, or Firm* — Fitzpatrick, Cella, Harper & Scinto

(57) ABSTRACT

A speaker system (10) with codirectional multichannels comprises a first diaphragm (11) associated with a first frequency range and a. second diaphragm (12) associated with a second frequency range, higher than the first frequency range. The first diaphragm (11) is disposed in an enclosure (13) and the second diaphragm (12) is disposed in front of the enclosure (13). The enclosure (13) comprises at least one vent (18) in an enclosure portion (15). The speaker system (10) comprises filtering means comprising a high-pass filter associated with a second frequency range, the cutoff frequency of the high-pass filter being higher than the natural frequency of the resonant cavity (19) created in the enclosure (13) provided with at least one vent (18).

8 Claims, 4 Drawing Sheets

SPEAKER SYSTEM WITH AT LEAST TWO CODIRECTIONAL CHANNELS

The present invention concerns a speaker system with at least two codirectional channels.

In general terms, the present invention concerns the field of sound and audio, and more precisely speaker systems comprising loudspeakers producing sound by virtue of a sound reproduction element, and for example by causing a diaphragm to vibrate.

Each sound reproduction element is configured to have optimal performance over a frequency range dedicated to it.

In order to reproduce the whole of a sound spectrum, covering the whole of the frequency band audible to the human ear (which extends from 20 Hz to 20 kHz), various loudspeakers are associated in the same speaker system. The frequency band of the sound spectrum to be reproduced is then separated into several audible frequency bands (also referred to as sub-bands or channels), each frequency band being reproduced by one of the loudspeakers.

In such a traditional system, means of filtering the frequency ranges are used, for example by a digital filtering of the currents supplying the various loudspeakers in the system, in order to supply each loudspeaker in the dedicated frequency range.

In this way interactions between the sound fields of the different channels are avoided to the best possible extent. In particular, a transition filtering technique (referred in English terminology as "crossover") is generally used, at the intersection of the frequency ranges dedicated to the various sound reproduction elements.

Thus, from the document FR 2 895 202, a speaker system is known comprising a first diaphragm disposed in a spherical enclosure, a second diaphragm being disposed in front of the first diaphragm relative to the direction of propagation of a sound wave.

The enclosure comprises longitudinal openings constituting vents to allow the emission of sound waves coming from the first diaphragm disposed at the rear in the enclosure.

These vents constitute obstacles and are liable to generate diffraction for the sound waves emitted by the second diaphragm. The vents are disposed as far as possible from the second diaphragm in order to minimise the phenomenon of diffraction of the sound waves emitted by the second diaphragm.

In such a speaker system configuration, a cavity is created in the enclosure in which the first diaphragm is disposed, behind the second diaphragm.

The aim of the present invention is to improve the sound quality of a speaker system with at least two codirectional channels in order to take into account the presence of a cavity created at the rear of a diaphragm of the speaker system.

For this purpose, the present invention concerns a speaker system with at least two codirectional channels, comprising a first sound reproduction element associated with a first frequency range and a second sound reproduction element associated with a second frequency range, higher than the first frequency range, the first sound reproduction element being disposed in an enclosure and the second sound reproduction element being disposed in front of the enclosure relative to the direction of propagation of a sound wave, the enclosure comprising at least one vent in an enclosure portion extending between the first sound reproduction element and the second sound reproduction element and the speaker system comprising means of filtering the frequency ranges comprising at least one high-pass filter associated with the second frequency range.

According to the invention, the cutoff frequency of the high-pass filter is higher than the natural frequency of the resonant cavity created in the enclosure provided with at least one vent.

This is because the applicant found that the cavity thus created in the enclosure housing the first sound reproduction element and provided with at least one vent fulfilled the role of a Helmholtz resonator, thus having a natural resonant frequency.

A fraction of the sound wave emitted by the second sound reproduction element enters this cavity.

If the frequency of a wave thus emitted by the second sound reproduction element is close to the natural frequency of the resonant cavity, it is then amplified so that the resonant cavity re-emits a secondary wave.

At the natural frequency of the resonant cavity, the secondary wave can have an energy comparable to the primary wave emitted by the second sound reproduction element so that this primary wave is strongly affected by the secondary wave and, from the point of view of acoustic quality, impairs the reproduction of the sound spectrum.

By virtue of the invention, the useful part of the second frequency range associated with the second sound reproduction element is situated beyond the natural frequency of the resonant cavity, so that the amplification caused by the resonant cavity on a sound wave emitted by the second sound reproduction element is situated in an inaudible zone of the sound spectrum reproduced by the second sound reproduction element.

According to an advantageous characteristic of the invention, the means of filtering the frequency ranges comprises a transition filter having a cutoff frequency in a frequency range of intersection of the first frequency range and the second frequency range, the cutoff frequency of the transition filter being higher than the natural frequency of the resonant cavity.

Thus the irregularity in the power response of the second sound reproduction element is situated below the cutoff frequency of the transition filter (or crossover), and is thus sufficiently low in the response of the second sound reproduction element to be greatly attenuated, or even inaudible.

Preferably a maximum cutoff frequency value is associated with the transition filter as a function of the first and second frequency ranges associated respectively with the first and second sound reproduction elements, and the number and dimensions of the vents are determined so that the natural frequency of the resonant cavity created in the enclosure is lower than the maximum value of the cutoff frequency of the transition filter.

In practice, in order to mute the irregularity produced by the amplification of part of the wave emitted by the second sound reproduction element close to the natural frequency of the resonant cavity, the intrinsic acoustic power delivered by the second sound reproduction element at the natural frequency of the resonant cavity is at least 5 dB less compared with a mean acoustic power delivered on the second frequency band by the said second sound reproduction element.

In practice, the first sound reproduction element is associated with a frequency range lying substantially between 20 and 200 Hz and the second sound reproduction element is associated with a frequency range lying substantially between 200 and 800 Hz.

According to another characteristic of the invention, the speaker system also comprises acoustic absorption means in the cavity, adapted to reduce the slope of the acoustic power signal delivered by the first sound reproduction element at frequencies higher than the natural frequency of the resonant cavity.

Thus the drop in acoustic power of the response of the first sound reproduction element is less rapid after the natural frequency of the resonant cavity.

The transition filter or crossover is thus easier to implement.

In one embodiment of the invention, the first and second sound reproduction elements are first and second diaphragms. In order to obtain coherent radiation between of the diaphragms of the speaker system, the first and second diaphragms are preferably coaxial.

In a practical embodiment of the invention, said second diaphragm is annular and the speaker system comprises at least a third diaphragm associated with a third frequency range, higher than the second frequency range, the third diaphragm being situated at the centre of the second annular diaphragm.

The speaker system can thus have a sufficient number of diaphragm to make it possible to reproduce the whole of the sound spectrum ranging from the low frequencies to the high-pitched frequencies, passing through the medium.

Other particularities and advantages of the invention will also emerge from the following description.

In the accompanying drawings, given by way of non-limitative examples:

A speaker system implementing the general principle of the invention will be described first of all with reference to FIGS. 1 and 2.

Figure 1:
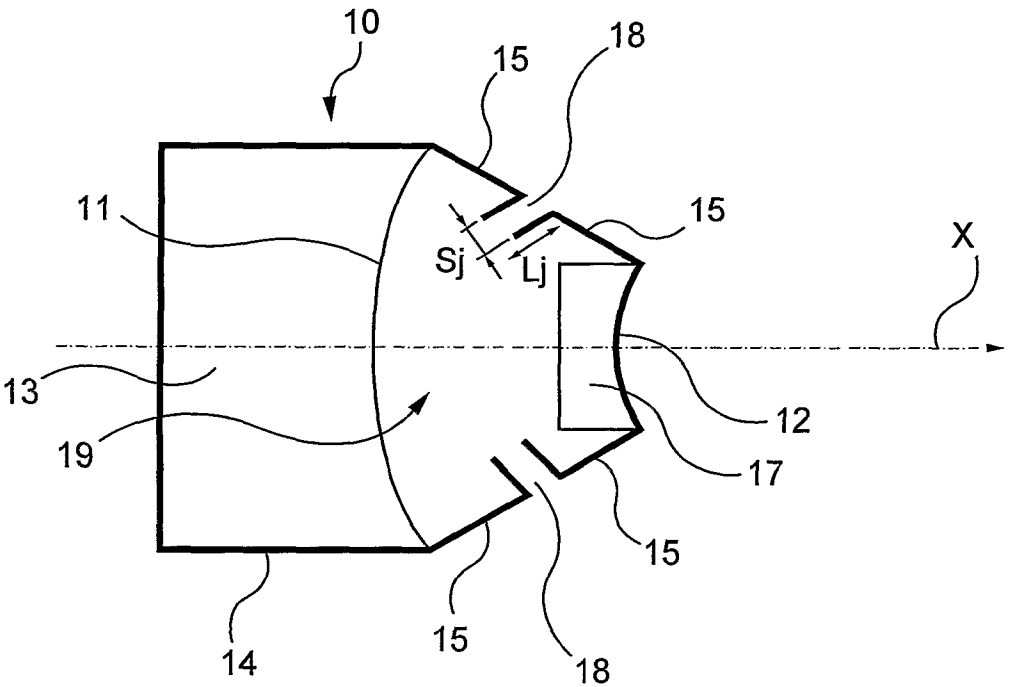
FIG. 1 is a diagram illustrating a speaker system according to one embodiment of the invention.

A speaker system 10 with two codirectional channels is illustrated schematically in FIG. 1.

Naturally the number of channels of the system is in no way fixed and may also be equal to or greater than three.

In the embodiment illustrated in FIG. 1, the speaker system 10 comprises a first sound reproduction element 11 associated with a first frequency range and a second sound reproduction element 12 associated with a second frequency range.

In the remainder of the description, it is considered that the sound reproduction elements are the diaphragms 11, 12, the vibration of which is for example controlled by electromagnetic means.

Naturally the sound reproduction elements may be different, and may for example be piezoelectric elements.

The second frequency range is higher than the first frequency range so that the first diaphragm is dedicated to a woofer channel and the second diaphragm is dedicated to a more high-pitched channel, and for example to a medium.

By way of example, the first diaphragm may be associated with a range of frequencies lying substantially between 20 and 200 Hz and the second diaphragm may be associated with a range of frequencies lying substantially between 200 and 800 Hz.

The first diaphragm 11 is housed in an enclosure 13 and the second diaphragm 12 is disposed in front of the enclosure 13, that is to say in front of the first diaphragm 11 in relation to the direction of propagation of a sound wave, represented schematically by the arrow X.

More precisely, the enclosure 13 comprises a box part 14 extending at the rear of the first diaphragm 11 and walls 15 extending in front of the first diaphragm 11 in relation to the direction of propagation X, between the first diaphragm 11 and the second diaphragm 12.

This second diaphragm 12 is itself placed in an enclosure 17 containing all the means necessary for causing the second diaphragm 12 to vibrate, used conventionally in loudspeakers, and which do not need to be described in any more detail here.

The enclosure 13 also contains all the means necessary for causing the first diaphragm 11 to vibrate.

This arrangement of the first and second diaphragms 11, 12 makes it possible to obtain two codirectional channels for reproducing a sound spectrum.

In this embodiment, the first and second diaphragms 11, 12 are also coaxial, with their axis aligned on the direction of propagation X, also making it possible to reduce the distance between the acoustic centre of emission of each of the diaphragms.

In order to allow the propagation of the sound wave generated by the first diaphragm 11, the walls 15 of the cavity 13 comprise openings 18 downstream of the first diaphragm 11 in the direction of propagation X of the sound wave, forming vents 18 for the passage of the acoustic vibrations coming from the first diaphragm 11.

Here, and in no way limitatively, two vents 18 are disposed symmetrically with respect to the coaxial direction of the diaphragms 11, 12.

Such a speaker system 10 also comprises means (not shown) of filtering the frequency ranges making it possible to separate frequency ranges of an audio signal and to direct them specifically towards one or the other of the diaphragms 11, 12.

These filtering means comprise in particular a high-pass filter associated with the second frequency range of the second diaphragm 12 making it possible to cut the frequencies below 200 Hz.

They also comprise a low-pass filter associated with the first frequency range of the first diaphragm 11, making it possible to cut the frequencies above 200 Hz.

The combination of this high-pass filter and this low-pass filter constitutes a transition filter, also referred to as a crossover in English terminology, having a cutoff frequency in a frequency range of intersection of the first frequency range and the second frequency range.

This transition filter or crossover makes it possible to adjust the power of the sound wave emitted by the two diaphragms in the areas of intersection or overlap of the frequency ranges.

By modifying the cutoff frequency and the slope of the response signal of each of the diaphragms, it is possible to obtain, in the superimposition area, a substantially stable acoustic power response in order to avoid the appearance of irregularities in the response of the speaker system.

The filtering means comprise, by way of non-limitative example, digital processing means composed conventionally of an electronic card and a unit for processing a digital signal (in English DSP or "Digital Signal Processor").

These digital filtering means are adapted to filter currents supplying each loudspeaker of the speaker system.

These filtering means make it possible to obtain a constant spectral response curve and a stable directivity index over the audible frequency band, ranging from 20 Hz to 20 kHz, even at the spectral transition zones of the diaphragms 11, 12 (overlap or intersection zones).

These filtering means also make it possible to compensate, by digital delays, the offsets in time of the sound waves coming from the different diaphragms.

These offsets in time result from the fact that the diaphragms are situated on the same axis but not in the same plane.

Thus the filtering means optimise the directivity of the diaphragms 11, 12 in order to obtain a stable response of the speaker system 10, devoid of any irregularity, and which is close to the response of an ideal acoustic system with several channels, in which the diaphragms would be mounted on the same axis and in the same plane.

This embodiment of a speaker system thus makes it possible to obtain a multichannel system, with codirectional and advantageously coaxial diaphragms, each dedicated to part of the sound spectrum.

As clearly illustrated in FIG. 1, this speaker system structure has the effect of creating a cavity 19 in the enclosure 13, between the first diaphragm 11 and the walls 15 of the enclosure provided with the vents 18.

This cavity 19 created at the rear of the second diaphragm 12 associated with its enclosure 17 acts as a Helmholtz resonator.

This is because a cavity provided with one or more vents has a natural resonant frequency dependent in particular on the geometry of the cavity and vents.

An electroacoustic model makes it possible to predict the natural frequency $f_0$ according to the geometry of the resonant cavity 19 formed by the walls 15 of the enclosure 13, the first diaphragm 11 and the enclosure part 17 associated with the second diaphragm 12.

According to this calculation model, the cavity 19 forms a Helmholtz resonator with the natural resonant frequency:

$$f_0 = \frac{1}{2\pi\sqrt{M_r C_C}}$$

where $M_r$ corresponds to the reduced total acoustic mass of the vents 18 and first diaphragm 11, and $C_c$ corresponds to the acoustic capacity of the cavity 19.

The reduced total acoustic mass $M_r$ can be determined as follows.

For a given speaker system geometry, the cavity 19 has a volume V and the vents 18 have a depth $L_j$ and a mean cross section $S_j$, j varying over the number of vents 18 provided on the wall 15 of the cavity 19.

The acoustic mass of each vent ej is given by the following formula:

$M_{ej}=\rho(L_j+1.45\sqrt{S_j/\pi})/S_j$ where ρ is the density of the air.

Since the vents ej are acoustically in parallel, the total acoustic mass of the vent system is:

$$M_e = 1\Big/\sum_j M_{ej}^{-1}$$

In addition, the first diaphragm 11 also has an acoustic mass M.

The vents 18 and the first diaphragm 11 thus have a reduced total acoustic mass $M_r$ given by the following formula:

$$M_r=M_e M_W/(M_e+M_W)$$

In addition, the cavity of volume V has an effective volume defined by $$V_{eff} = V - \sum_j 0.6\sqrt{S_j/\pi}\, S_j.$$

Thus the cavity 19 has an acoustic capacity $C_C=V_{eff}/\rho c$ where c is the speed of sound in air and ρ the density of air.

The natural frequency $f_0$ of the resonator can thus be calculated.

It should also be noted that the natural frequency $f_0$ of the resonator can be determined for a given speaker system by measuring a frequency response in the cavity 19.

Thus, by placing a measuring microphone in the cavity 19 and exciting the first diaphragm 11 on the audible frequency band, ranging from 20 Hz to 20 kHz, it is possible observe the frequency response of the measurement.

This frequency response will have a characteristic peak at the natural frequency $f_0$ of the resonator.

A Helmholtz resonator having a natural frequency $f_0$ has the characteristic of strongly amplifying the sound waves emitted at this cavity at a frequency close to the natural frequency of the resonator.

Thus a proportion of the primary wave emitted by the second diaphragm 12, entering the cavity 19, which fulfils the role of a Helmholtz resonator, is amplified in the vicinity of the natural frequency $f_0$ of the cavity 19.

This cavity 19 next re-emits a secondary wave, the total sound field then corresponding to the sum of the primary and secondary waves at the listening point.

At the natural frequency $f_0$, the re-emitted secondary wave may have an energy comparable to the primary wave emitted by the second diaphragm 12 so that the latter is greatly affected.

According to the phase difference and the difference in energy between the primary and secondary waves, an irregularity in the response curve of the second diaphragm can then be observed in the vicinity of the natural frequency $f_0$.

Figure 2:
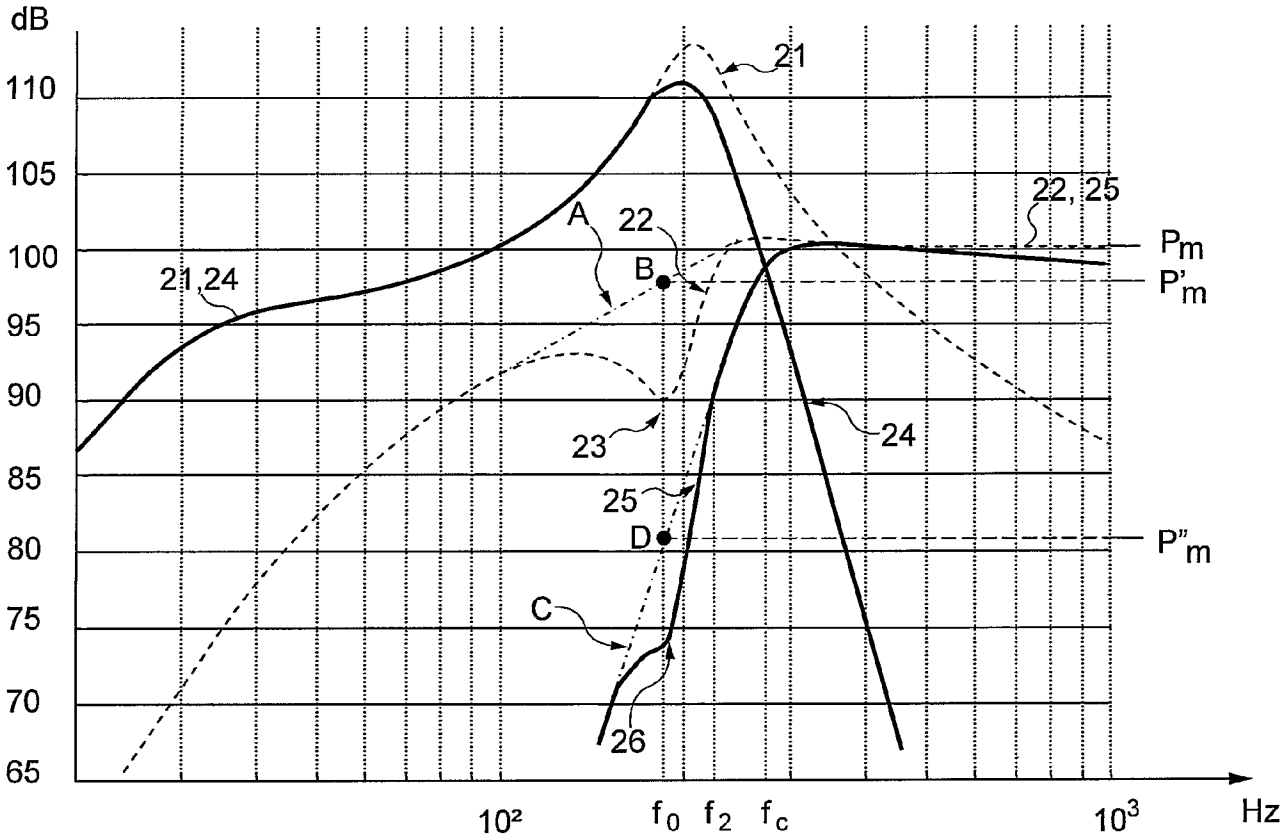
FIG. 2 is a graph illustrating the response in decibels of a speaker system according to one embodiment of the invention as a function of the excitation frequency.

The response curve in decibels of each diaphragm 11, 12 is illustrated in FIG. 2 as function of the excitation frequency of each diaphragm 11, 12.

The curves in broken lines 21, 22 represent schematically the power response curve respectively of the first diaphragm 11 and second diaphragm 12 as a function of the excitation frequency.

As indicated previously, the first diaphragm 11 is sized and configured so as to obtain an optimal response curve in terms of acoustic power in the low frequencies, typically between 20 and 200 Hz.

The second diaphragm 12 on the other hand is sized and configured so as to obtain an optimal response curve in terms of acoustic power for frequencies of the low medium, lying typically between 200 and 800 Hz.

As clearly illustrated at the point referenced 23, in the vicinity of the natural frequency $f_0$ of the resonator formed by the cavity 19, an irregularity may be found on the frequency response curve 22 of the second diaphragm 12, corresponding as explained previously to the sum of the primary and secondary waves at the listening point (here in phase opposition, introducing a drop in the response of the second diaphragm 12 at the natural frequency $f_0$), As indicated previously, according to the volume of the cavity, the acoustic mass of the vents and the first diaphragm 11, and thus in particular the number and size of the vents, the natural frequency $f_0$ of the resonant cavity 19 may vary.

As illustrated in FIG. 2, in the embodiment of the invention, the natural frequency $f_0$ is situated in the low part of the second frequency range dedicated to the second diaphragm 12.

By regulating the cutoff frequency of a high-pass filter used in the speaker system 10, the natural frequency $f_0$ of the resonant cavity 19 is lower than the cutoff frequency $f_2$ of the high-pass filter dedicated to the filtering of the frequency band associated with the second diaphragm 12.

By thus ensuring that the cutoff frequency $f_2$ of the high-pass filter is higher than the natural frequency $f_0$ of the resonant cavity 19, it is guaranteed that any irregularity in the acoustic power response of the second diaphragm 12 would take place in a part of the sound spectrum where the intrinsic acoustic power is less than the mean acoustic power of $P_m$ delivered on the second frequency band by the second diaphragm 12.

The intrinsic acoustic power is represented schematically by the curve A in a dot and dash line in FIG. 2, and corresponds to the acoustic power response of the second diaphragm 12 taken in isolation, in the absence of any external disturbance and in particular in the absence of a cavity, or in other words in the absence of a vent in the wall of the enclosure.

The curve portion A thus corresponds to the frequency response curve 22 of the second diaphragm 12 in the absence of disturbance.

As clearly illustrated in FIG. 2, the irregularity at point 23 at the natural frequency $f_0$ is situated at a point B on the intrinsic acoustic power curve of the second diaphragm 12, having an acoustic power $P'_m$ less that the mean acoustic power $P_m$, and for example 2 dB lower with respect to this acoustic power $P_m$.

There have also been illustrated in FIG. 2, in solid lines, the power response curves 24 and 25 respectively of the first diaphragm 11 and second diaphragm 12 with the use of a transition filter or crossover in the overlap zone of the frequency bands.

The intrinsic acoustic power curve C of the second diaphragm 12 with the use of a transition filter or crossover has been illustrated in a dot and dash line.

As clearly illustrated in FIG. 2, the cutoff frequency $f_c$ of the transition filter or crossover is higher itself than the natural frequency $f_0$ of the resonant cavity 19.

Consequently the configuration of the speaker system 10 of the invention makes it possible both to reduce the natural frequency $f_0$ of the resonant cavity 19, by suitably sizing this cavity 19 and the vents 18, and to increase the cutoff frequency $f_c$ of the transition filter or crossover between the first diaphragm 11 and the second diaphragm 12.

Thus the irregularity at the point 26 at the natural frequency $f_0$ is situated at a point D on the intrinsic acoustic power curve C of the second diaphragm 12, having an acoustic power $P''_m$, at the point D, approximately 20 dB lower with respect to the mean power $P_m$.

Thus the residual irregularity illustrated by the point 26 in FIG. 2 is situated under the cutoff frequency $f_c$ of the transition filter or crossover, in a part of the power response of the second diaphragm 12 in which this irregularity is no longer audible.

The transition filter or crossover ensures in particular good coupling of the frequency responses of the first diaphragm 11 and second diaphragm 12 in an area of intersection or overlap of the frequencies between the first frequency range and the second frequency range.

For a given first diaphragm 11 and second diaphragm 12, a maximum cutoff frequency value $f_c$ can be associated with the transition filter or crossover according to the first and second frequency ranges associated respectively with the first and second diaphragms.

The number and dimensions of the vents 18 are then determined so that the natural frequency $f_0$ of the resonant cavity 19 created in the enclosure 13 is lower than this maximum value of the cutoff frequency of the transition filter or crossover.

As clearly illustrated in FIG. 2, the transition filter or crossover is also regulated so that the slope of the acoustic power signal delivered by the second diaphragm 12 is sufficient so that the intrinsic acoustic power $P''_m$ delivered by the second diaphragm 12 at the natural frequency $f_0$ is at least 5 dB less with respect to the mean acoustic power $P_m$ delivered on the second frequency band, and here approximately 20 dB less.

The irregularity 26 in the frequency response curve is thus almost inaudible.

Figure 3:
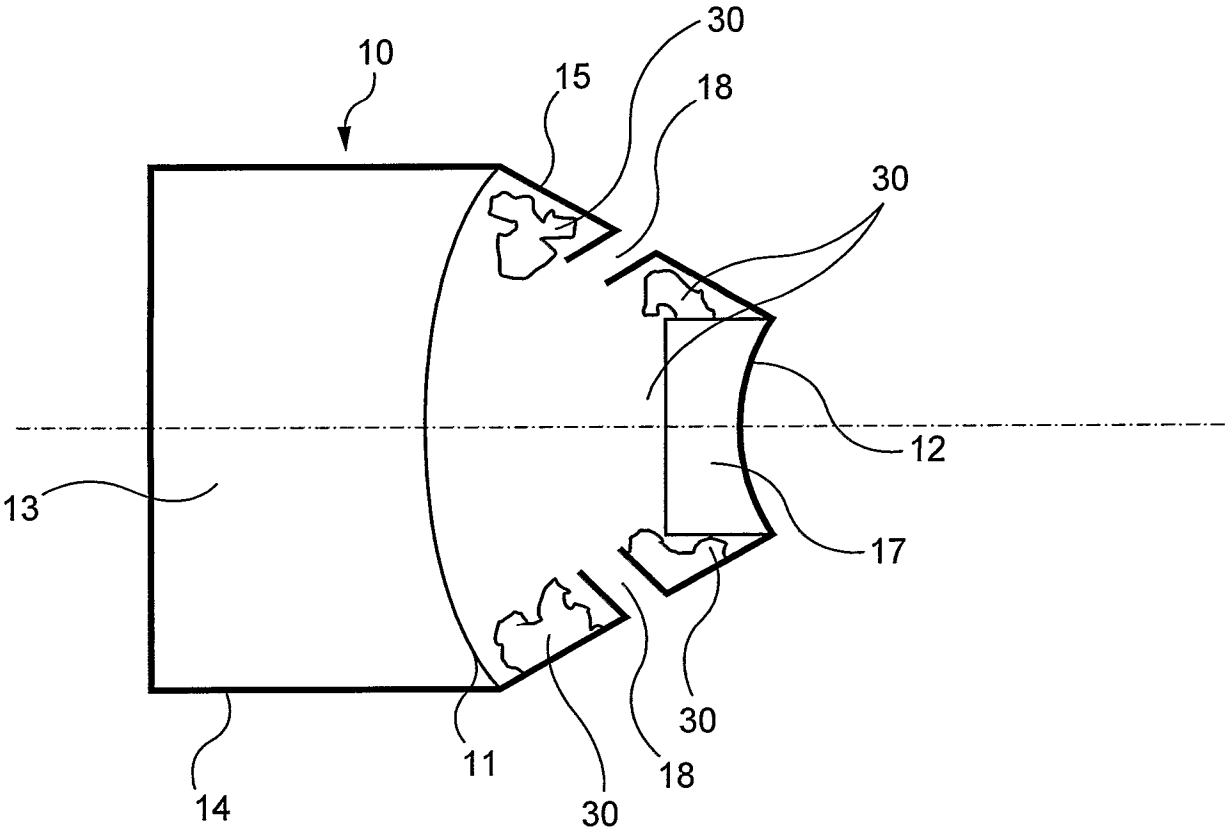
FIG. 3 is a diagram illustrating a speaker system according to a second embodiment of the invention.

FIG. 3 illustrates a second embodiment of the invention.

The elements identical to the first embodiment bear the same numerical references and will not be redescribed here.

In order to add an acoustic resistance in the cavity 19, acoustic absorption means 30 are disposed in the cavity 19.

It is possible to use in particular a damping acoustic material 30 disposed against the walls 15 of the enclosure 13, on each side of the vents 18.

Naturally, other acoustic absorption means could be used (acoustic leakage, acoustic grid, resonant spring-mass system, etc).

These acoustic absorption means are adapted to reduce the slope of the acoustic power signal delivered by the first diaphragm 11 at frequencies higher than the natural frequency $f_0$ of the resonant cavity 19.

Thus the power drop of the frequency response (see in particular curve 24 in FIG. 2) of the first diaphragm 11 is less rapid after the natural frequency $f_0$.

The transition filter or crossover used thus has less steep slopes and allows easier implementation.

This is because, since the power drop is less accentuated, the frequency band that can be used for the transition filter or crossover is wider.

The slope being less steep, the number of coefficients of a digital filter used for the transition filter is lower.

Thus, when the transition filter or crossover is implemented by a digital so filtering of the current supplying the means of causing the diaphragms to vibrate, the digital calculation at the transition filter or crossover is less expensive and demands less calculation power of the DSP card (the acronym for the English term "Digital Signal Processor").

In addition, the acoustic absorption means make it possible to create an acoustic damping in the cavity 19 and thus to reduce the gain of the Helmholtz resonator.

Consequently the secondary wave reproduced by the resonator is weaker so that the irregularity found at the superimposition of the primary and secondary sound waves is less pronounced.

Figure 4:
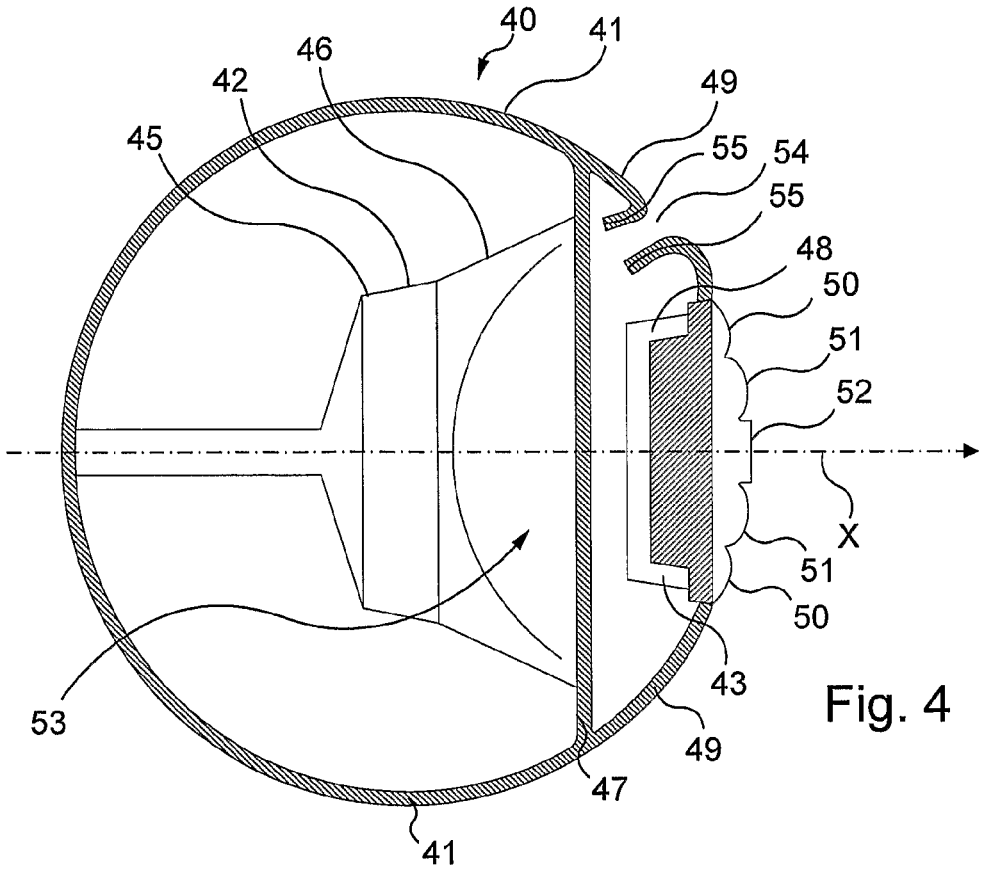
FIG. 4 illustrates a practical embodiment of a multichannel speaker system according to the invention.
Figure 5:
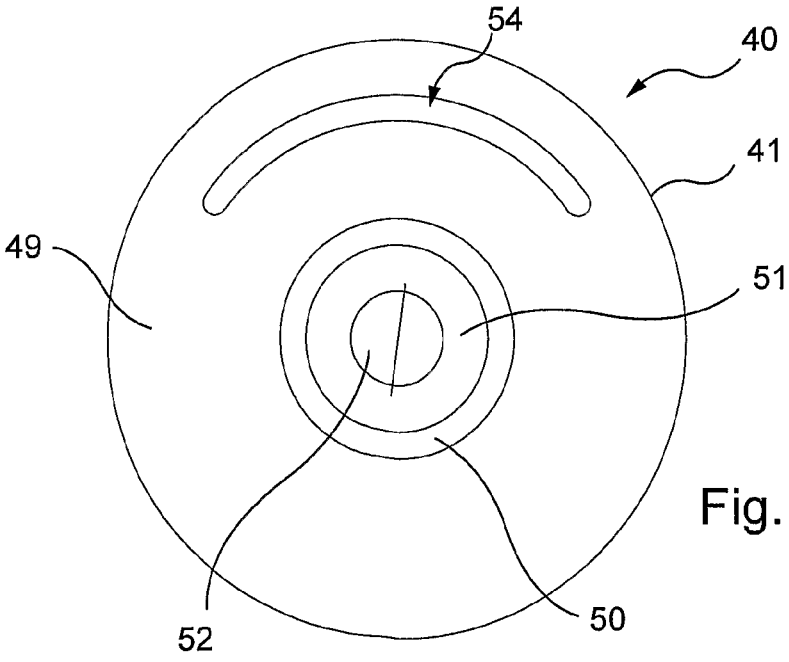
FIG. 5 is a front view of the speaker system of FIG. 4.

FIGS. 4 and 5 illustrate a practical embodiment of an speaker system implementing the present invention.

In this embodiment, the speaker system 40 is a system with four coaxial channels along an axis X.

In this embodiment, the enclosure 41 is spherical in shape. In this enclosure 41 two sound production assemblies 42, 43 are housed.

A first sound production assembly 42 comprises a first diaphragm 44 dedicated to a low-frequency range.

The first sound production assembly 42 also comprises conventional electromagnetic means 45 actuating the first diaphragm 44.

By way of example, this first diaphragm is concave in shape and has an outside diameter of approximately 55 cm.

It is associated flexibly (by means of an elastic element, not shown) with a chassis 46.

This first sound production assembly 42 is mounted inside the enclosure 41, the chassis 46 being fixed to an annular periphery 47 of the enclosure 41.

The first diaphragm 44 thus makes it possible to reproduce at least certain frequencies lying between 20 Hz and 200 Hz.

The second sound production assembly 43 comprises a housing 48 mounted in a wall 49 of the enclosure 41. This wall 49 extends the enclosure 41 beyond the first diaphragm 44 and the annular mounting periphery 47 of the first sound production assembly 42.

The box 48 can typically be held by means of adhesive bonding to the wall 49.

In practice, the enclosure 41 comprises here, in its front wall 49, relative to the direction of propagation X of the sound waves, an opening in the shape of a disc for housing the box 48 of the second sound production assembly 43.

Preferably this second sound production assembly is adapted to reproduce the complementary sound spectrum, extending substantially between 200 Hz and 20,000 Hz.

In this embodiment, the second sound production assembly 43 comprises three coaxial and concentric diaphragms 50, 51, 52.

An external annular diaphragm 50 is dedicated to the low medium frequencies (typically 200 to 800 Hz), an intermediate annular diaphragm 51 is dedicated to the high medium frequencies (typically 800 to 3,000 Hz) and a central diaphragm in the form of a disc 52 is dedicated to the high-pitched frequencies (typically 3,000 to 20,000 Hz).

The speaker system 40 thus makes it possible to reproduce the entire sound spectrum audible to the human ear from 20 Hz to 20 kHz.

As indicated previously with reference to FIG. 1, a cavity 53 is created inside the enclosure 41 between the first diaphragm 44 and the wall 49 in which the second sound production assembly 43 is mounted.

In this embodiment, a vent 54 is provided in the wall 49 of the enclosure 41.

As clearly illustrated in FIG. 5, this vent 54 has a semi-annular shape extending over a portion of an arc of a circle concentric and coaxial with the diaphragms 50, 51, 52 of the second sound production assembly 43.

As explained previously, this cavity 53 provided with a vent 54 has a natural resonant frequency $f_0$.

The dimensions of this vent 54 must be such that the natural frequency $f_0$ of the cavity 53, also influenced by the size of the cavity 53 and the characteristics of the first diaphragm 44, is less than the cutoff frequency of the transition filter or crossover separating the sound spectrum dedicated to the two sound production assemblies 42, 43, or at the very least is lower than the cutoff frequency of the high-pass filter dedicated to the range of low medium frequencies reproduced by the external annular diaphragm 50 closest to the vent 54.

It should also be noted that, in this embodiment, the edges of the vent 54 are formed by portions of walls pushed towards the inside of the cavity 53, inside the enclosure 41, and constitute wings extending towards the inside of the enclosure 41. The ends 55 of these wings are splayed, that is to say, they are directed towards the inside of the enclosure 41 moving away from each other.

By virtue of the spherical and substantially smooth shape of the wall 49 and the splaying of the ends 55 of the vent 54, the diffraction of the sound waves emitted by the second sound production assembly 43, and in particular by the external annular diaphragm 50, is reduced, the sound quality of the medium thus being improved.

There will be given below examples of sizing of such a speaker system 10 making it possible to obtain a natural frequency $f_0$ of the resonant cavity 54 lower than the cutoff frequency of a transition filter or crossover.

EXAMPLE 1

Volume of cavity 53: 16 liters
Depth of vent 54: 5.3 cm
Cross section of vent 54: 139 $cm^2$
Acoustic mass of the first diaphragm 44: 22 $kg/m^4$ The natural frequency $f_0$ of the resonator created by the cavity 53 and the vents 54 is around 178 Hz.

For a useful frequency band of the first diaphragm, corresponding to the diaphragm 44, ranging up to 250 Hz, the maximum value of the cutoff frequency acceptable to the transition filter or crossover is approximately equal to 200 Hz.

Since the natural frequency $f_0$ of the resonator is lower than this maximum value, it is possible to configure the transition filter so as to have a cutoff frequency higher than the natural frequency $f_0$ of the resonator and thus avoid any irregularity in the response signal of the medium.

EXAMPLE 2

Volume of cavity 53: 11.5 liters
Depth of vent 54: 10 cm
Cross section of vent 54: 155 $cm^2$
Acoustic mass of the first diaphragm 44: 22 $kg/m^4$ The natural frequency $f_o$ of the resonator created by the cavity 53 and the vents 54 is around 188 Hz.

For a useful frequency band of the first diaphragm, corresponding to the diaphragm 44, ranging up to 250 Hz, the maximum value of the cutoff frequency acceptable for the transition filter or crossover is approximately equal to 200 Hz.

Since the natural frequency $f_0$ of the resonator is lower than this maximum value, it is possible to configure the transition filter so as to have a cutoff frequency higher than the natural frequency $f_0$ of the resonator and thus avoid any irregularity in the response signal of the medium.

However, having regard to the proximity between the natural frequency $f_0$ of the resonator and the maximum cutoff frequency of the crossover, this configuration is more difficult to implement.

This is because a transition filter or crossover having a cutoff frequency at 200 Hz for a natural frequency of the medium of 160 Hz makes it possible to have a reasonable slope in the frequency response curve while ensuring that the intrinsic power response at the medium at the natural frequency $f_0$ of the resonator is low, and for example 5 dB lower with respect to the mean acoustic power.

When the natural frequency $f_0$ of the resonator is around 188 Hz, it is necessary to have, at the transition filter or crossover, a very steep slope of the response signal if an intrinsic power response of the medium that is sufficiently low at the natural frequency $f_0$ of the resonator is desirable.

EXAMPLE 3

Volume of cavity 53: 8.2 liters
Depth of vent 54: 8.5 cm
Cross section of vent 54: 110 $cm^2$
Acoustic mass of the first diaphragm 44: 40 $kg/m^4$ The natural frequency $f_o$ of the resonator created by the cavity 53 and the vents 54 is around 188 Hz.

For a useful frequency band of the first diaphragm, corresponding to the diaphragm 44, ranging up to 300 Hz, the maximum value of the cutoff frequency acceptable for the transition filter or crossover is approximately equal to 240 Hz.

Since the natural frequency $f_0$ of the resonator is lower than this maximum value, it is possible to configure the transition filter so as to have a cutoff frequency higher than the natural frequency $f_0$ of the resonator and thus avoid any irregularity in the response signal of the medium.

Thus the speaker system according to the invention is optimised in terms of regularity in the acoustic power transmitted by the speaker system over the entire sound spectrum.

Naturally the present invention is not limited to the example embodiments described above.

In particular, the shape of the enclosure and the sizes and numbers of the diaphragms of the speaker system can be modified.

Moreover, although the speaker system described above makes it possible to reproduce, from four channels, a sound spectrum ranging from 20 Hz to 20,000 Hz, any other configuration of speaker system and loudspeaker can be used in the context of the present invention to cover various sound spectra (for example from 50 Hz to 1.00 Hz or from 50 Hz to 20 kHz).

Finally, the diaphragms of the speaker system could be offset, instead of coaxial, whilst remaining oriented substantially in the direction of the sound wave emission.

The invention claimed is:

1. A speaker system with at least two codirectional channels, comprising:

a first sound reproduction element associated with a first frequency range;

a second sound reproduction element associated with a second frequency range higher than the first frequency range, the first sound reproduction element being disposed in an enclosure and the second sound reproduction element being disposed in front of the enclosure relative to the direction of propagation (X) of a sound wave, the enclosure comprising at least one vent in an enclosure portion extending between the first sound reproduction element and the second sound reproduction element; and means of filtering the frequency ranges comprising at least one high-pass filter associated with the second frequency range, wherein the cutoff frequency ($f_c$) of the high-pass filter is higher than the natural frequency ($f_o$) of a resonant cavity defined in part by the enclosure portion, and wherein the resonant cavity is in communication with the at least one vent, wherein the means of filtering the frequency ranges comprises a transition filter having a cutoff frequency ($f_c$) in a range of frequencies of intersection of the first range of frequencies and the second range of frequencies, the cutoff frequency ($f_c$) of the transition filter being higher than the natural frequency ($f_o$) of the resonant cavity, and a maximum cutoff frequency value ($f_c$) being associated with the transition filter as a function of the first and second frequency ranges associated respectively with the first and second sound reproduction elements, wherein the number and dimensions of the vents are determined so that the natural frequency ($f_o$) of the resonant cavity created in the enclosure is lower than the maximum value of the cutoff frequency ($f_c$) of the transition filter.

2. The speaker system according to claim 1, wherein the intrinsic acoustic power delivered by the second sound reproduction element at the natural frequency ($f_o$) of the resonant cavity is at least 5 dB lower with respect to a mean acoustic power ($P_m$) delivered on the second frequency band by the second sound reproduction element.

3. The speaker system according to claim 1, wherein the first sound reproduction element is associated with a frequency range lying substantially between 20 and 200 Hz and the second sound reproduction element is associated with a range of frequencies lying substantially between 200 and 800 Hz.

4. The speaker system according to claim 1, further comprising acoustic absorption means in the cavity, adapted to decrease the slope of an acoustic power signal delivered by the first sound reproduction element at frequencies higher than the natural frequency ($f_o$) of the resonant cavity.

5. The speaker system according to claim 1, wherein the first and second sound reproduction elements are first and second diaphragms.

6. The speaker system according to claim 5, wherein the first and second diaphragms are coaxial.

7. The speaker system according to claim 6, wherein the second diaphragm is annular and the speaker system further comprises at least a third diaphragm associated with a third frequency range, higher than the second frequency range, the third diaphragm being situated at the center of the second diaphragm.

8. The speaker system according to claim 1, wherein the at least one vent is spaced axially between the first sound reproduction element and the second sound reproduction element in the direction of propagation (X).

* * * * *